US008857596B2

(12) United States Patent
Ito

(10) Patent No.: US 8,857,596 B2
(45) Date of Patent: Oct. 14, 2014

(54) BANKNOTE PROCESSING APPARATUS

(75) Inventor: Kazuyoshi Ito, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/504,942

(22) PCT Filed: Apr. 26, 2011

(86) PCT No.: PCT/JP2011/060177

§ 371 (c)(1),
(2), (4) Date: Apr. 27, 2012

(87) PCT Pub. No.: WO2011/155276

PCT Pub. Date: Dec. 15, 2011

(65) Prior Publication Data

US 2012/0211328 A1 Aug. 23, 2012

(30) Foreign Application Priority Data

Jun. 11, 2010 (JP) ..... 2010-134285

(51) Int. Cl.
*G07F 7/04* (2006.01)
*G07D 11/00* (2006.01)

(52) U.S. Cl.
CPC ..... *G07D 11/0084* (2013.01)
USPC ..... 194/206; 194/350

(58) Field of Classification Search
USPC ..... 194/206, 350; 235/379; 209/534
See application file for complete search history.

(56) References Cited

U.S. PATENT DOCUMENTS

| | | | | |
|---|---|---|---|---|
| 5,555,983 | A * | 9/1996 | Yamagishi | 209/534 |
| 7,225,911 | B2 * | 6/2007 | Yokoi et al. | 194/205 |
| 7,252,185 | B2 * | 8/2007 | Fujita et al. | 194/350 |
| 8,348,043 | B2 * | 1/2013 | Smith | 194/350 |
| 2005/0139447 | A1 * | 6/2005 | Minamishin et al. | 194/206 |
| 2008/0047801 | A1 * | 2/2008 | Nakatsuka et al. | 194/206 |

FOREIGN PATENT DOCUMENTS

| | | | |
|---|---|---|---|
| CN | 1828674 | A | 9/2006 |
| JP | 11-328495 | A | 11/1999 |
| JP | 2006-058939 | A | 3/2006 |
| JP | 2009-048664 | A | 3/2009 |

* cited by examiner

*Primary Examiner* — Mark Beauchaine
(74) *Attorney, Agent, or Firm* — Rabin & Berdo, P.C.

(57) ABSTRACT

The present invention provides a banknote processing apparatus that enables left-behind banknotes to be removed by a lower rank employee and prevents banknotes inside a safe casing from being removed by a lower rank employee, thereby achieving increased convenience of use and ensuring the security of the banknotes inside the safe casing. Namely, a banknote processing apparatus is provided in which, by providing a left-behind banknote storage section for storing and managing banknotes that have been left behind by a customer in a withdrawal transaction inside a unit disposed above a safe casing, when returning left-behind banknotes stored in the left-behind banknote storage section in response to a request from a customer, the left-behind banknotes can be removed from the left-behind banknote storage section by pulling out the unit, without opening the safe casing in which a large number of banknotes are stored and managed.

8 Claims, 3 Drawing Sheets

BANKNOTE PROCESSING APPARATUS

TECHNICAL FIELD

The present invention relates to a banknote processing apparatus that is incorporated in an automated teller machine installed in a premises, such as of a financial institution, and performs deposit and withdrawal processing of banknotes.

BACKGROUND ART

In a banknote processing apparatus, generally a large number of banknotes that have either been deposited or have been made ready for withdrawal are held within the apparatus. Therefore, for security reasons, the storage section for storing the banknotes has a sturdy safe casing provided with a lock and functioning as a safe. Banknotes that have been left behind by a customer and reject banknotes are also stored in the safe casing.

Explanation follows regarding an example of a conventional banknote processing apparatus. FIG. 2 is a perspective view illustrating the external appearance of an automated teller machine. FIG. 2 shows an automated teller machine (referred to below as an ATM) 1. The ATM 1 is installed in an operational branch of a financial institution, or for example in a convenience store, gasoline stand or supermarket. The ATM 1 is connected through a communication line to a host computer (not shown in the drawings) administered and maintained by a financial institution.

The host computer includes a storage device (customer database, not shown in the drawings) stored with customer data, such as, account number, name, and savings balance data, for users. The ATM 1 performs transactions, such as, deposits and withdrawals while exchanging data with the host computer.

2 is a customer operation and display section provided on an upper portion of the front face of the apparatus. The customer operation and display section 2 is configured with a display section and a touch panel. The display section displays screens such as transaction selection screens and screens for guiding a customer through a transaction operation. The touch panel is employed for input operation of transaction selections made according to the display on the display section, and for input of data required for a transaction.

A card insertion and return slot 3 is provided at one side below the customer operation and display section 2. The card insertion and return slot 3 is the section where a customer-identifying card (referred to below as a cash card) is inserted when starting a transaction, and the section from which the cash card is returned when a transaction has been completed. The card insertion and return slot 3 is connected to a card processing section provided inside the apparatus. The card processing section reads out a code (number) for each financial institution and customer data, such as account number and name of the user, that have been stored on the cash card.

A ten-key section 4 is the section for customer input according to a transaction guidance screen displayed on the customer operation and display section 2, for example input of a personal identification number (PIN). The ten-key section 4 may also be configured as operation keys displayed on the customer operation and display section 2. The customer operation and display section 2 configured as illustrated is sloped so as to rise up, in order to make it difficult for a third party standing behind the user to read the PIN, and is provided at a substantially horizontal portion at a location on the apparatus front face that is obscured by the body of a customer.

5 is a receipt issuing slot provided at a location below the card insertion and return slot. The receipt issuing slot 5 is connected to a receipt processing section provided inside the apparatus, and the receipt processing section prints transaction receipts, and issues the receipts to customers.

6 is a proximity detector provided at a specific position on the apparatus front face. The proximity detector 6 is a sensor for detecting the approach of a customer to the ATM 1. The customer operation and display section 2 displays a transaction selection screen when the proximity detector 6 has detected a customer. 7 is an external shutter provided to a banknote deposit and withdrawal handling port positioned at a central portion below the customer operation and display section 2. 8 is a related banknote processing apparatus incorporated in the ATM 1, and has a banknote deposit processing function and a banknote withdrawal processing function. A detailed explanation regarding the related banknote processing apparatus 8 is given later.

9 is a controller that controls the ATM 1 overall. The controller 9 has a memory section 10 serving as a storage section and configured for example from RAM, ROM or a hard disk, in which programs such as a control program are stored. The controller 9 also has an interface section (not shown in the drawings) that acts as the connection interface to a host computer. Note that the ATM 1 is also equipped with many other functions and configuration elements that are not explained, such as a power supply section for supplying power to each of the sections.

FIG. 3 is a schematic side view illustrating an internal configuration of the conventional banknote processing apparatus 8. Explanation follows regarding the configuration of the banknote processing apparatus 8, with reference to FIG. 3. 11 is an internal shutter mounted to the banknote processing apparatus 8. The internal shutter 11 is provided so as to be positioned at the inside of the external shutter 7. The external shutter 7 can be swung open or closed in the arrow A direction using for example a motor (not shown in the drawings). The internal shutter 11 similarly can be opened or closed by moving in the substantially horizontal arrow B direction using for example a motor (not shown in the drawings). Sensors (not shown in the drawings) are respectively disposed on the external shutter 7 and the internal shutter 11 for detecting the open or closed positions of the external shutter 7 and the internal shutter 11.

12 is a deposit and withdrawal port. The deposit and withdrawal port 12 has functions to receive banknotes that have been introduced by a customer during a deposit transaction, separate the banknotes and draw them into the apparatus. The deposit and withdrawal port 12 also has functions for accumulating banknotes during a withdrawal transaction and is the section where payout to a customer is performed. The external shutter 7 and the internal shutter 11 are in the open state when banknotes have been introduced into the deposit and withdrawal port 12 and also when banknotes are dispensed from the deposit and withdrawal port 12.

13 is a checking section provided for checking the authenticity and counting banknotes that have been deposited and banknotes being dispensed. 14 is a temporary holding section that temporarily holds banknotes during deposit and withdrawal processing.

15 are plural denomination specific cassettes provided for storing banknotes according to denomination. 16 is a reject note cassette that stores reject banknotes. 17 is a left-behind banknote storage section that stores banknotes that have been left behind. 18 is a safe casing, and the safe casing 18 internally houses the plural denomination specific cassettes 15, the reject note cassette 16 and the left-behind banknote storage section 17. The safe casing 18 is formed for example from thick metal plate and is provided with a lock so as to function as a sturdy safe.

19 is a conveying path that connects the deposit and withdrawal port 12, the checking section 13, the temporary holding section 14, each of the denomination specific cassettes 15, the reject note cassette 16 and the left-behind banknote storage section 17, for conveying banknotes therebetween. A switching section (not shown in the drawings) is provided at each of the branched points in the conveying path 19 for switching the conveying direction of the banknotes.

In banknote processing apparatus 8 as configured above, when a customer selects, for example, a deposit transaction using the customer operation and display section 2 of the ATM 1 and introduces banknotes into the deposit and withdrawal port 12, the external shutter 7 and the internal shutter 11 shut, and the introduced banknotes are separated into single banknotes and conveyed to the checking section 13. Then, in the banknote processing apparatus 8, checking is performed in the checking section 13 for such factors as the authenticity and denomination of the banknotes, and the banknotes are counted. After counting the banknotes are then conveyed to the temporary holding section 14 where they are temporarily held. A count result is displayed on the customer operation and display section 2 in the banknote processing apparatus 8 when checking, counting, and temporary storage, has been performed for all of the banknotes introduced into the deposit and withdrawal port 12. When the customer has seen and confirmed the count result, the banknote processing apparatus 8 feeds out the temporarily stored banknotes from the temporary holding section 14 and conveys the banknotes to the checking section 13. The banknote processing apparatus 8 then re-checks the denomination and the like and conveys the banknotes to the denomination specific cassettes 15 according to their denomination, and stores the banknotes according to denomination.

On the other hand, in the banknote processing apparatus 8, when a customer has selected a withdrawal transaction using the customer operation and display section 2 and entered the amount, banknotes are fed out from the denomination specific cassettes 15 and conveyed to the checking section 13 where a check is performed on the banknotes, such as checking their denominations, and the banknotes are counted. After the denominations of the banknotes have been determined and the banknotes have been counted, the banknotes are then conveyed to the deposit and withdrawal port 12 where they are accumulated. In the banknote processing apparatus 8, when banknotes of the amount entered by the customer have been accumulated in the deposit and withdrawal port 12, the external shutter 7 and the internal shutter 11 are opened and the banknotes are paid out. Note that in a withdrawal transaction, when banknotes checked in the checking section 13 are found to have an indeterminate denomination or detected as having abnormal conveying, such banknotes are conveyed as reject banknotes to the temporary holding section 14 where they are temporarily stored. Then, in the banknote processing apparatus 8, after normal banknotes have been paid out to the customer, the reject banknotes are conveyed from the temporary holding section 14 to the reject note cassette 16 where they are stored.

However, if the banknotes are not actually taken when a specific duration has elapsed from when the external shutter 7 and the internal shutter 11 were opened in the above withdrawal, namely when a sensor (not shown in the drawings) provided to the deposit and withdrawal port 12 is still detecting the stacked banknotes, the controller 9 determines that the banknotes have been left behind by a customer, and closes the external shutter 7 and the internal shutter 11. The controller 9 then causes the banknotes to be separated into single banknotes, and the banknotes to be conveyed to the left-behind banknote storage section 17 where they are stored and held (see for example Japanese Patent Application Laid-Open (JP-A) No. 2006-58939).

DISCLOSURE OF INVENTION

Technical Problem

In the above conventional banknote processing apparatus, in order to ensure the security of banknotes stored in the safe casing, and in particular the large number of banknotes in the denomination specific cassettes, very often rights to open the safe casing are assigned according to the employee (the operators for financial institutions and people with authority, such as shop mangers, and general shop staff for convenience stores). In such cases lower rank employees (such as sub-operators and general shop staff) do not normally handle keys for opening the safe casing or facility keys so they are not able to remove banknotes inside the safe casing. However, with respect to left-behind banknotes, sometimes it would be better if even a lower rank employee was able to remove the banknotes.

For example, there is a requirement for left-behind banknotes stored in the left-behind banknote storage section to be returned to a customer on demand. However sometimes a higher rank employee (higher rank operator or responsible person) is not present, and a lower rank employee is asked to respond. It is therefore desirable for a lower rank employee to be able to remove left-behind banknotes in such instances.

However, when rights to open a safe casing are assigned according to the employee, if a lower rank operator was allowed to carry the key to the lock of the safe casing in order to enable the lower rank employee to remove left-behind banknotes, then the lower rank employee would also be able to remove banknotes from the denomination specific cassettes, thereby compromising security. However, if a lower rank employee is not allowed to carry the key to the lock on the safe casing in order to maintain security, then the inconvenience arises that left-behind banknotes cannot be returned to a customer in response to a demand when there is no higher rank employee present, and convenience is not obtained. Consequently, it is difficult to combine both security and convenience with a conventional banknote processing apparatus.

An object of the present invention is to solve the above.

Solution to Problem

A first aspect of the present invention is a banknote processing apparatus including, a safe casing with internally installed denomination specific cassettes for storing banknotes according to denomination, wherein the banknote processing apparatus checks banknotes that have been fed out from the denomination specific cassettes during a withdrawal transaction, counts the banknotes, and pays the banknotes out to a customer from a customer interface port, and wherein a left-behind banknote storage section for storing banknotes, that have been left behind by a customer, is provided in a separate unit to the safe casing, configured such that the unit can be pulled out from the apparatus.

Advantageous Effects of the Invention

In the banknote processing apparatus of the present invention configured as described above, left-behind banknotes can be removed from the left-behind banknote storage section by pulling out the unit, without opening the safe casing in which the large number of banknotes are stored and managed. Consequently, left-behind banknote removal by a lower rank employee may be enabled, even when the access rights to the safe casing are assigned according to the employee. In addition the banknote processing apparatus of the present invention may also be capable of preventing banknotes from being removed from the denomination specific cassettes by a lower rank employee. Accordingly, the banknote processing apparatus of the present invention may increase the convenience of use while still ensuring a high level of security for the large number of banknotes.

BEST MODE FOR CARRYING OUT THE INVENTION

Explanation follows regarding an exemplary embodiment of a banknote processing apparatus according to the present invention, with reference to the drawings.

Figure 1:
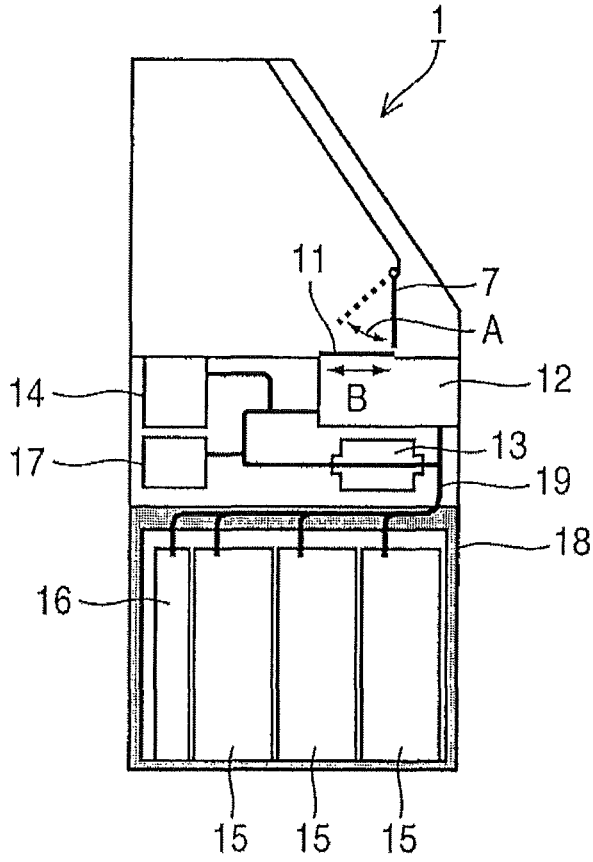
FIG. 1 is a schematic side view illustrating an internal configuration of a banknote processing apparatus of an exemplary embodiment of the present invention.
Figure 2:
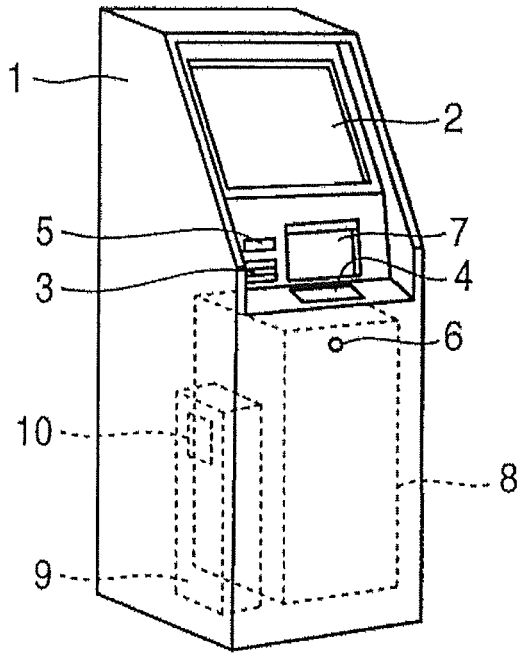
FIG. 2 is a perspective view illustrating the external appearance of an ATM.
Figure 3:
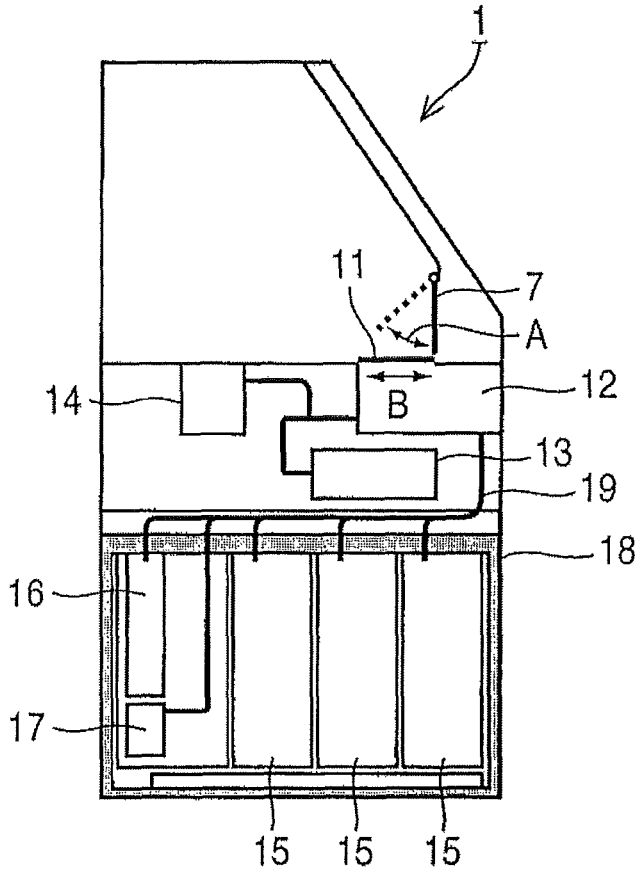
FIG.3 RELATED ART
FIG. 3 is a schematic side view illustrating an internal configuration of a conventional banknote processing apparatus.

FIG. 1 is a schematic side view illustrating an internal configuration of an exemplary embodiment of the present invention. The banknote processing apparatus of the present exemplary embodiment is provided with a left-behind banknote storage section 17 that is provided inside a unit disposed above a safe casing 18. A deposit and withdrawal port 12, a checking section 13, a temporary holding section 14 and a conveying path 19 are provided inside the unit. The left-behind banknote storage section 17 is, for example, disposed below the temporary holding section 14. The unit is configured to be capable of being pulled out by opening a door (not shown in the drawings) provided in the back face, for example, of the apparatus casing. The door is capable of being locked and unlocked with a key. Other sections of the configuration are similar to those of a conventional apparatus.

Similar deposit and withdrawal processing to that of a conventional banknote processing apparatus can also be performed with the thus configured banknote processing apparatus. Namely, when a customer selects, for example, a deposit transaction using the customer operation and display section 2 of the ATM 1, and introduces banknotes into the deposit and withdrawal port 12, the external shutter 7 and the internal shutter 11 shut. Then, the banknote processing apparatus separates the introduced banknotes into single banknotes and conveys them to the checking section 13. Then, Checking is performed in the checking section 13 for such factors as the authenticity and denomination of the banknotes, and the banknotes are counted. Then, after counting the banknotes, the banknote processing apparatus conveys the banknotes to the temporary holding section 14 where they are temporarily held. The banknote processing apparatus displays a count result on the customer operation and display section 2 when checking, counting and temporary storage have been performed for all of the banknotes introduced into the deposit and withdrawal port 12. When the customer has seen and input a confirmation of the count result, the banknote processing apparatus feeds out the temporarily stored banknotes from the temporary holding section 14, and conveys the banknotes to the checking section 13 where re-checks such as on the denomination are performed. The banknote processing apparatus then conveys the banknotes to the denomination specific cassettes 15 according to their denomination and stores the banknotes according to denomination.

On the other hand, when a customer has selected a withdrawal transaction using the customer operation and display section 2 and entered the amount, banknotes are fed out from the denomination specific cassettes 15 and conveyed to the checking section 13 where a check is performed on the banknotes, such as checking their denomination, and the banknotes are counted. Then, after the banknotes have been counted, the banknote processing apparatus then conveys the banknotes to the deposit and withdrawal port 12 where they are accumulated. When banknotes of the amount entered by the customer have been accumulated in the deposit and withdrawal port 12, the banknote processing apparatus opens the external shutter 7 and the internal shutter 11 and pays out the banknotes. Note that in such a withdrawal transaction, when banknotes checked in the checking section 13 are found to be reject banknotes with an indeterminate denomination, such banknotes are conveyed as reject banknotes to the temporary holding section 14 where they are temporarily stored. Then in the banknote processing apparatus, after normal banknotes have been paid out to the customer, the reject banknotes are conveyed from the temporary holding section 14 to the reject note cassette 16 where they are stored.

Further, if the banknotes are not actually taken when a specific duration has elapsed from when the external shutter 7 and the internal shutter 11 were opened in the above withdrawal, namely when a sensor (not shown in the drawings) provided to the deposit and withdrawal port 12 is still detecting the stacked banknotes, the controller 9 determines that the banknotes have been left behind by a customer, and closes the external shutter 7 and the internal shutter 11. The banknote processing apparatus then separates the banknotes into single banknotes, and the banknotes are conveyed to the left-behind banknote storage section 17. In such cases, the banknotes are conveyed to the left-behind banknote storage section 17 through the checking section 13, and are stored and held in the left-behind banknote storage section 17.

As explained above, in the exemplary embodiment of the present invention, the left-behind banknote storage section 17 for storing and managing banknotes, that have been left behind by a customer in a withdrawal transaction, is provided inside a unit that is disposed above the safe casing 18. Consequently, in the banknote processing apparatus of the present exemplary embodiment, in order to return left-behind banknotes stored in the left-behind banknote storage section 17 in response to a demand from a customer, the left-behind banknotes can be removed from the left-behind banknote storage section 17 by pulling out the unit, without opening the safe casing 18 in which a large number of banknotes are being stored and managed. Accordingly, in the banknote processing apparatus of the present exemplary embodiment, it is still possible for the left-behind banknotes to be removed by a lower rank employee, even when rights of access to the safe casing 18 are assigned according to the employee. The banknote processing apparatus of the present exemplary embodiment is also capable of preventing banknotes from being taken out from the denomination specific cassettes by a lower rank employee. Consequently, the banknote processing apparatus of the present exemplary embodiment is able to increase convenience of use while still ensuring a high level of security for the large number of banknotes.

The invention claimed is:

1. A banknote processing apparatus comprising:
a housing having a front side and a back side;
a safe casing with internally installed denomination specific storage units for storing banknotes according to denomination and with a reject note storage unit for storing rejected banknotes, the safe casing being disposed within the housing; and
a unit provided above and external to the safe casing and configured such that the unit can be pulled out from the banknote processing apparatus, the unit including:
a customer interface port for accumulating banknotes during a withdrawal transaction and for dispensing the banknotes, the customer interface port being disposed at the front side of the housing,
a checking section that performs checking and counting of the banknotes,
a left-behind banknote storage section, disposed below a temporary holding section, for storing banknotes that have been left behind by a customer, and
a conveying path for conveying the banknotes,
wherein left-behind banknotes stored in the left-behind banknote storage section can be taken out by pulling the unit out of the housing of the banknote processing apparatus.

2. The banknote processing apparatus of claim 1, wherein the unit can be pulled out of the housing of the banknote processing apparatus from the back side of the housing.

3. A banknote processing apparatus comprising:
a housing having a front side and a back side
a first unit, which only a high-rank operator can operate, with internally installed denomination specific storage units for storing banknotes according to denomination and with a reject note storage unit for storing rejected banknotes, the first unit being disposed within the housing; and
a second unit, which an operator other than the high-rank operator can operate, the second unit being disposed within the housing above and external to the first unit and being configured such that the second unit can be pulled out from the banknote processing apparatus, the second unit including:
a customer interface port, disposed at the front side of the housing, for accumulating banknotes during a withdrawal transaction and for dispensing the banknotes,
a checking section that performs checking and counting of the banknotes,
a left-behind banknote storage section, disposed below a temporary holding section, for storing banknotes that have been left behind by a customer, and
a conveying path for conveying the banknotes to a temporary holding section that temporarily holds the checked banknotes,
wherein any left-behind banknotes stored in the left-behind banknote storage section can be taken out by pulling the second unit out of the banknote processing apparatus.

4. The banknote processing apparatus of claim 3, wherein the second unit can be pulled out of the banknote processing apparatus from the back side of the housing.

5. A banknote processing apparatus comprising:
a housing having a front side and a back side;
a display section mounted on the housing at the front side thereof;
a safe casing inside the housing;
at least one banknote cassette inside the safe casing; and
a reject note cassette, disposed inside the safe casing, for storing rejected banknotes;
a unit, disposed within the housing, that is mounted for movement into or out of the housing, the unit including:
a customer interface port through which banknotes can be passed, the customer interface port being disposed at the front side of the housing,
a checking section for checking the banknotes,
a left-behind banknote storage section for storing banknotes that have been left behind by a customer, and
a conveying path for conveying the banknotes,
wherein, when the unit is moved out of the housing, the display unit remains at the front side of the housing.

6. The banknote processing apparatus of claim 5, wherein the unit further includes a temporary holding section that temporarily holds banknotes during a transaction.

7. The banknote processing apparatus of claim 5, wherein the unit is located below the display section and above the safe casing when the unit is disposed in the housing.

8. The banknote processing apparatus of claim 5, wherein the unit is mounted for movement into or out of the housing via the back side of the housing.

* * * * *